United States Patent [19]

Walzel

[11] Patent Number: 4,466,104

[45] Date of Patent: Aug. 14, 1984

[54] METALLURGICAL PLANT

[75] Inventor: Leopold Walzel, Dusseldorf, Fed. Rep. of Germany

[73] Assignee: Mannesmann Aktiengesellschaft, Dusseldorf, Fed. Rep. of Germany

[21] Appl. No.: 339,106

[22] Filed: Jan. 13, 1982

[30] Foreign Application Priority Data

Jan. 27, 1981 [DE] Fed. Rep. of Germany ..... 3102499

[51] Int. Cl.[3] ..... F27B 14/00; F27D 3/00

[52] U.S. Cl. ..... 373/78; 373/83; 373/84

[58] Field of Search ..... 373/78, 79, 83, 84, 373/71, 43; 432/128, 166, 207; 266/142, 143

[56] References Cited

U.S. PATENT DOCUMENTS

| | | | |
|---|---|---|---|
| 1,018,727 | 2/1912 | Ruthenburg | 373/79 |
| 2,696,663 | 12/1954 | Wright et al. | 266/142 |
| 2,957,936 | 10/1960 | Bugge | 373/83 |
| 3,379,815 | 4/1968 | Parker | 373/78 |
| 3,404,209 | 10/1968 | Brooke | 373/84 |
| 3,612,739 | 10/1971 | Korneff | 373/78 |
| 3,612,740 | 10/1971 | Gierek | 373/78 |

FOREIGN PATENT DOCUMENTS

| | | |
|---|---|---|
| 1433424 | 2/1969 | Fed. Rep. of Germany . |
| 1900629 | 9/1969 | Fed. Rep. of Germany . |
| 2241079 | 4/1973 | Fed. Rep. of Germany . |
| 2819836 | 11/1978 | Fed. Rep. of Germany . |
| 2921702 | 12/1980 | Fed. Rep. of Germany . |

*Primary Examiner*—Roy N. Envall, Jr.
*Attorney, Agent, or Firm*—Mandeville and Schweitzer

[57] ABSTRACT

A metallurgical plant is provided with a plurality of electric arc furnace vessels arranged so that the centers of the vessels lie along the points of an imaginary circle. A lid having the electrical supply for the furnaces is rotatable onto the furnaces by having its pivot point positioned at the center of the imaginary circle.

Other features of the plant are disclosed including the use of open-topped support members for supporting the vessels; gate type valves at the bottoms of the vessels for tapping; below-the-charging-floor rail tracks for transporting the products of the vessel; a mechanism for lifting, on one side, the vessels to selectively skim off the slag layer; etc.

8 Claims, 6 Drawing Figures

METALLURGICAL PLANT

BACKGROUND OF THE INVENTION AND DESCRIPTION OF THE PRIOR ART

The invention relates to a steelmaking plant having electric arc furnaces which can be tapped at their bottoms.

Until now, it has been customary to form steelmaking plants or factories from individual steelmaking units, i.e., from electric arc furnaces, each such furnace unit being self-contained, i.e., having all the necessary components required for its operation.

It is an object of the invention, however, to increase the output of such a plant while keeping the investment costs approximately constant. The present invention is directed to a novel steelmaking plant which consists of several individual furnace vessels which are arranged on a single charging floor and each of which is provided with a tapping door which can be closed off. For the several vessels, (preferably two), only a single lid and only one electrical supply installation are provided, both of which are attached to a mobile supporting structure which can be alternatively positioned in the operating position above either of the vessels, as desired.

The present invention is premised on the background knowledge that the operator of an electric arc furnace installation ordinarily keeps a second reserve furnace vessel in complete readiness. When repairs, generally to the refractory lining, have to be carried out on the vessel which has been in operation, the reserve furnace is called into action. According to the present invention, this ordinarily reserve-only furnace vessel, which is unused most of the time, can be now called upon for increasing product output and for improving the efficiency of the operational process, without requiring any significantly additional expenditure. The present invention results in a furnace installation in which both vessels are used, alternately, in the course of normal operation. Should one of the vessels require repairs which last longer than expected, the other vessel is still always available for use, so that the output usually achieved with one vessel is at least produced during this period.

The alternating operation of two furnace vessels results in many advantages. These are, inter alia, that the lid and the electrodes do not cool off between changes and that energy losses, otherwise caused by this cooling off are eliminated. In addition, as a result of avoiding intermediate cooling, the furnace lid will exhibit longer service life since it will not be subject to as frequent periodic thermal changes. Moreover, a more uniform utilization of the power supply is achieved, because energy is consumed almost continuously, rather than periodic peaking due to high power drainage and total shut-downs.

Since each vessel is available after each charge, for the same period of time, about 2.5 hours, smaller repars can be carried out without particular time pressure. Moreover, scrap can be charged for a longer period of time before the furnace is energized and can be preheated by the retained heat radiating from the just used furnace vessel. Again, it can be seen that energy is saved.

When using the product of the present invention in a continuous casting plant, considerable advantages occur because the steel, provided by the steel furnaces of the present invention, sought to be cast is available at shorter intervals than heretofore present and, therefore, smaller intermediate vessels can be used.

The relatively uninterrupted operation of the present invention and the use of only a single lid for two furnace vessels is made especially possible by the fact that furnace vessels having bottom tapping mechanisms are used which, in contrast to the prior art furnace vessels which require tilting for tapping, i.e., the lid and its electrode attachments participated in the tilting motion, have lower relative investment cost, also allow for more rapid tapping possible, while, at the same time accomplishing this in considerably less space.

SUMMARY OF THE INVENTION

According to one aspect of the invention, the supporting structure for the lid consists of a centilever, which can be pivoted about a vertical axis, the furnace vessels being arranged on an arc of a circle which is concentric with the pivot axis of the cantilever. Such equipment is particularly easily constructed and, moreover, offers the advantage that the power supply, connected to the electrodes, no longer needs to have the degree of mobility which is required by the prior art tiltable furnaces. The electric power is supplied under electrically controlled conditions, to a position lying essentially in the vertical axis of the cantilever and, from there, from the cantilever to the electrodes.

Should space requirements demand it, the supporting structure for the lid may, according to a different embodiment of the invention, consist of a mobile gantry, which is movable above the furnace vessels. In the case of this embodiment, however, a correspondingly movable power supply is required.

Since, in some cases, it may be desirable to remove the formed slag from the top layer of the steel melt, the essentially stationary furnace vessels can, if desired, be constructed so that they can be upwardly lifted by a slight amount; experience has shown that about 6° is sufficient. This is able to be accomplished in a particularly simple manner if the furnace vessels are supported in three supports which are open towards the top. The lifting motion, required for skimming off the layer of slag, can then be carried out with the aid of a simple lifting mechanism, which is mounted on that support of the furnace vessel, located radially opposite the tapping opening for allowing the skimmed slag to be taken off.

The simple supports, usable for furnace vessels of the type herein proposed, also permit furnace vessels to be lifted upwardly out, with the help of an ordinarily available crane so that the furnaces can be exchanged or repaired and if more extensive work is needed, the cranes can be used to lift the furnaces and then set them down on a repair stand. In this manner, the space located below the charging floor becomes accessible to the crane through the upwardly extending opening, which space was previously occupied by the furnace. Access to this space is also an advantage, particularly if and when the steel or slag has accidentally spilled over the side of the furnace because of operator error or because of other furnace damage.

It is also an aspect of the invention to equip the bottom of the furnace vessels with gate type valves, because these permit steel to be accurately separated from the slag. This, in turn, allows for the possibility of adding alloying materials to the cast steel so that subsequent independent alloying work in a casting ladle is no longer required.

For carrying out various maintenance chores and, in addition, for exchanging bottom valves in a convenient manner, it is another aspect of the invention to arrange, at the underside of the charging floor, a lifting table, which, as desired, can be selectively moved beneath the tapping opening of the furnace vessel. The lifting table can be advantageously mounted on a vehicle constructed in the nature of a cable type carrier, i.e., like a gondola. By so constructing the plant, the floor of the smelting plant, underneath the tapping platform, remains free for the unencumbered movement of steel and slag-laden carriages. Since the operating processes in the two furnace vessels are preferably staggered timewise, it is only necessary to provide one set of parallel rails, passing under the furnace vessels, for transporting the steel and slag-laden carriages.

An additional advantage of the inventive plant, disclosed herein, results from the overall viewing, aobve as well as below the charging floor, so that the furnaces can be operated with only a few operators present. Two furnace vessels, which are arranged next to one another and onto which the lid with the electrical supply installation is alternately moved for carrying out the melting process in the desired furnace vessel, can be monitored and controlled by one operator. The same applies to the observation and monitoring of the tapping process from the tapping platform.

All processes, previously employed in steel electric arc furnaces, can readily be carried out with the inventively proposed plant, for example, melting of scrap, first charged in a basket, melting or addition of pellets, and the like.

The invention is explained by means of the drawings.

DETAILED DESCRIPTION OF THE DRAWINGS

Figure 1:
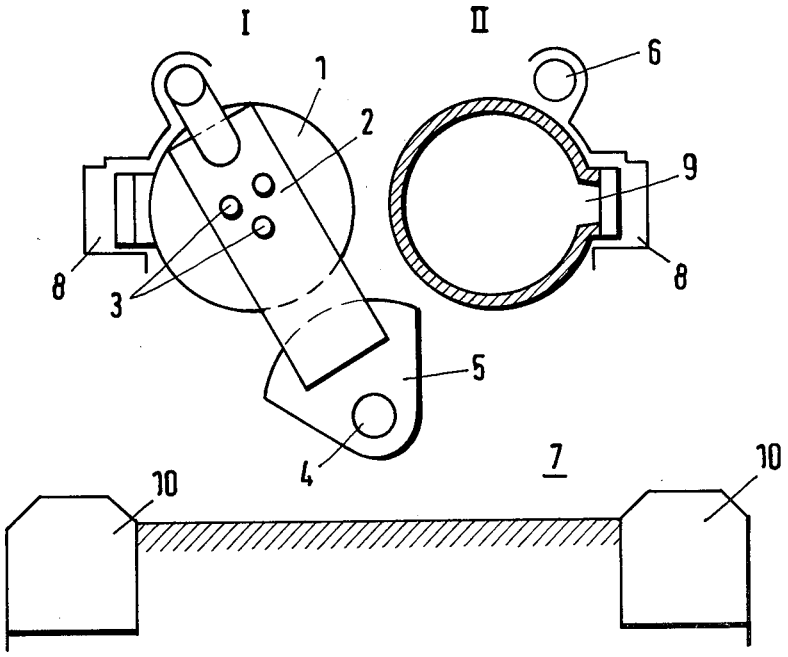
FIG. 1 is a top plan view of a first embodiment of the steelmaking plant constructed according to the present invention.

The top plan view, shown schematically in FIG. 1, consists of a steelmaking plant of two furnace vessels I and II, arranged next to each other on a charging floor. For both furnace vessels, only one furnace lid 1 and one electrical supply installation comprised of electrodes 3 having a mount and lifting mechanism, as well as power supply, are provided. The lid 1 and the electrical supply installations are attached on a cantilever mechanism 2, which is itself secured onto a platform 5. This arrangement, consisting of the cantilever 2 and the platform 5, is held by a vertical pillar 4, about which the cantilever 2 and platform 5 can pivot in a horizontal plane. The pillar 4 is precisely arranged in relation to the position of the furnace vessels such that the lid 1, with the electrical supply installations, can be pivoted, alternatively, over either of the two furnace vessels I or II, as desired. The pivot axis, formed by the pillar 4, is at the center of an arc of a circle passing through the mid-points of the furnace vessels I and II.

The lid 1 is constructed in the usual manner and is equipped with an exhaust pipe 6 at the so-called "fourth hole" of the lid. The exhaust pipe 6 is in the form of an elbow and, in the operating positions, resides above fixed connecting pieces. The nature of the arrangement of the mounting of the electrodes and the other electrical supply apparatus also corresponds to the usual construction. For example, the platform 5 serves as a base for the attachment of the hydraulic lifting cylinders for the mounting of the electrode and the associated controls, so that the electrodes can be raised and lowered relative to the lid. The lid 1, itself, is raised and lowered with the help of the support 4, whose height can be varied to the extent necessary for both the pivoting between furnaces and the subsequent lowering into the desired furnace vessel.

As also shown in FIG. 1, the furnace vessels I and II are each equipped with a lateral opening 9 (only the opening for vessel II is shown in FIG. 1). The charging floor 7 is provided with a tapping opening 8 (see FIGS. 1 and 4). The use of these elements is further explained with reference to FIG. 4.

In the arrangement of FIG. 1, the pivoting angle of the cantilever 2 is approximately 60°. The two furnace vessels I and II, therefore, take up relatively little space.

Figure 2:
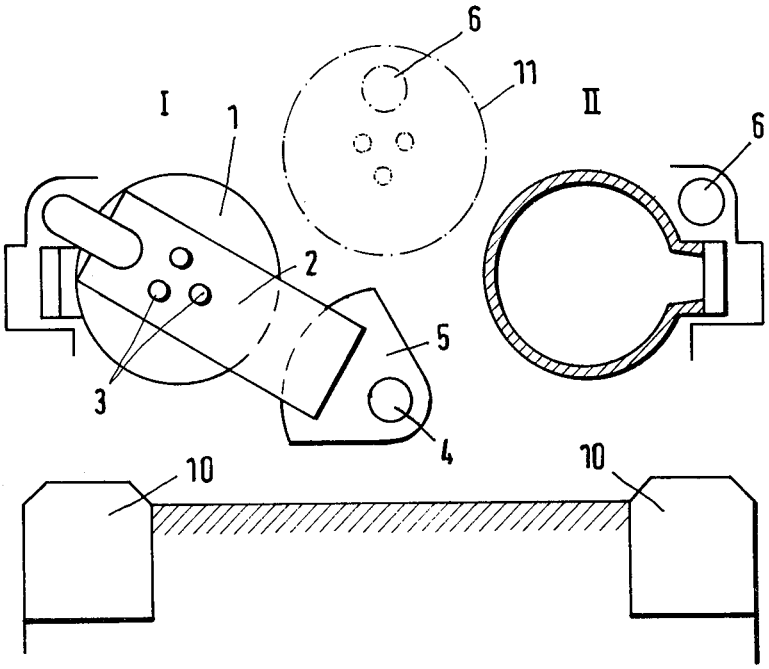
FIG. 2 is a top plan view of a second embodiment of the present invention.

Insofar as the available floor space allows, the two furnace vessels I and II can also be stationed further apart, so that, as shown in FIG. 2, the lid 1 can be brought to an intermediate position between the furnaces, in which the lid 1 stands above a shield 11 which prevents the loss of the radiated heat and prevents the heat from escaping. In this position of the lid, the electrodes can be worked on (i.e., nippled) by a stand there situated. In the case of the vessels being arranged as shown in FIG. 1, this step of the process would be carried out by a separate working stand (not shown) provided at the side of the vessels.

Figure 3:
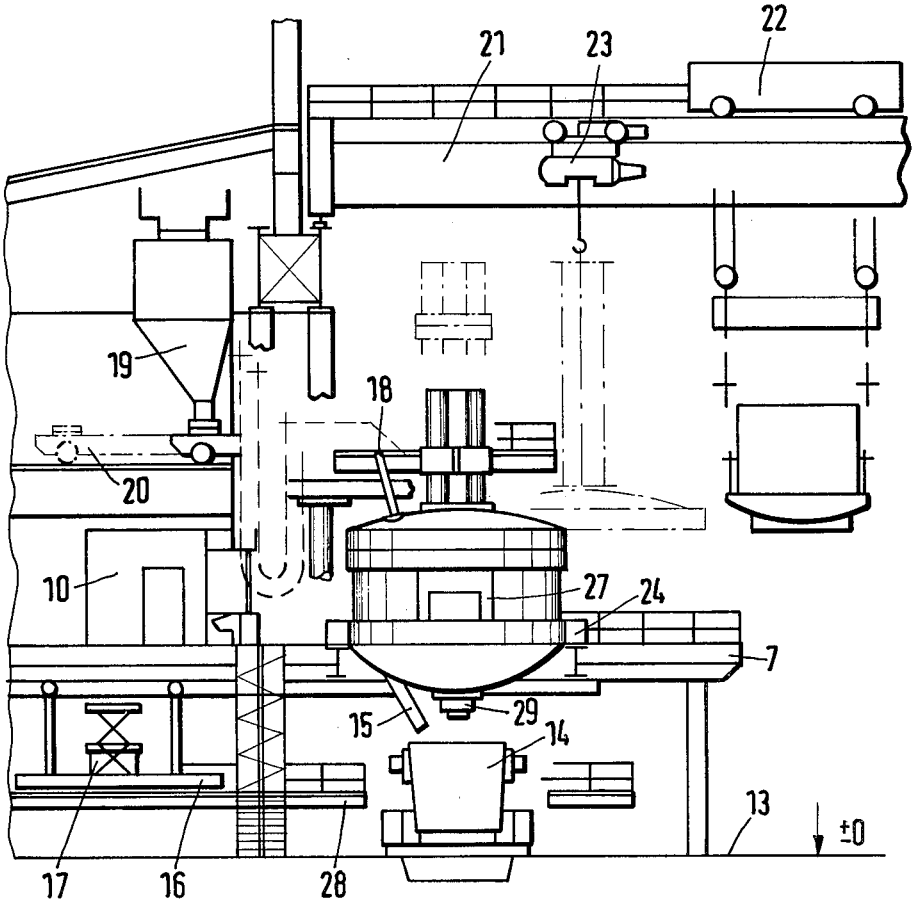
FIG. 3 is a side view of the plant shown in FIG. 2.

FIG. 3 shows a side view of the essential components of the steelmaking factory. The furnace vessel is arranged on the charging floor 7, which is provided with a bottom cut-out 8, through which the lower part of the vessel protrudes. The furnace vessel rests on supports 24 (see FIGS. 3 and 4), preferably on three supports equidistantly located over the furnace circumference. The supports 24 are opened upwardly so that, in case of need, the vessels can be exchanged rapidly and effortlessly by lifting a vessel out of the supports and dropping in a different vessel.

At its lowermost point, the vessel has a bottom valve 29, which preferably is constructed as a gate type valve. The tapping platform 28 is arranged below the charging floor 7. Below the bottom valve 29, parallel rail tracks are laid on the floor 13 of the smelting plant, which serve to facilitate transportation of the steel discharging carriages 14 or the slag carriages. The rails pass under both of the furnace vessels which are located one behind the other in FIG. 3.

Equipment 15 is provided for feeding alloying materials. The equipment 15 is in the vicinity of the charging floor 7 and the area of the bottom valve 29. When, as mentioned, the furnace vessel is equipped with a gate type valve 29, the alloying material can be added, through equipment 15, directly into the steel discharging carriages 14 while the steel is tapped. The gate type valves facilitate the addition of alloying materials, since the use of the valves allow for accurate metering of the quantity of steel tapped and the rate of tapping. Consequently, subsequent work in the ladle becomes unnecessary. Moreover, the gate type valves can also be used for accurately separating steel from slag, because it can be selectively opened and closed at a very high speed with relative high accuracy.

In the region of the casting platform 28, a mobile platform 16 is suspended from above, which can be selectively moved under the furnace vessel and from which maintenance work can be carried out, if necessary, on the bottom valve 29. If desired, a lift table 17 can be placed on the suspended platform 16, which facilitates the exchange, if necessary, of the valve 29. Because of the alternating mode of operation of the two furnace vessels, I and II, a sufficient time between charges is available for servicing each vessel, i.e., repairing of the bottom valves, exchanging them, if necessary, making them more operational between the individual charges, lubricating them, etc.

It can also be seen in FIG. 3 that the furnace lid is located above the furnace vessel. The lid 1, itself, is equipped with a feed pipe 18 providing for pellets into the furnace. A source of supply of the pellets is the mobile bunker 19, located above a reversible conveyor belt 20, which is equipped with conveyor scales.

As indicated by the dashed lines in FIG. 3, the lid 1 is capable of being pivoted to the working or nippling station by swiveling on the cantilever 2. Prior to the swinging motion, however, there is, of course, a short lifting motion by which the lid is first freed from the vessel.

With the aid of a charging crane 22 moving overhead on a crane bridge 21, the furnace vessels can be selectively charged with scrap. At least one other small trolley 23 can be provided for use for transporting the electrodes from the electrode storage area to the nippling stand. The small trolley 23 can travel on the same crane bridge 21 as the charging crane 22.

Figure 4:
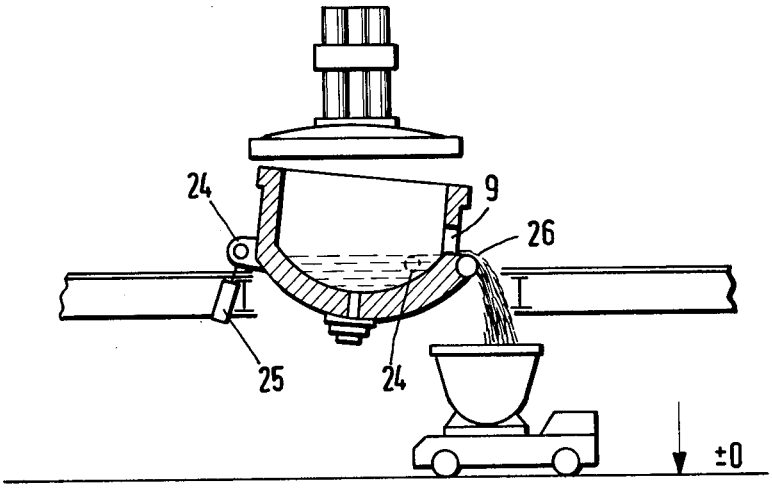
FIG. 4 is a side view of the tapping procedure carried out by a furnace vessel shown in FIG. 5.

Should it be necessary or desirable, slag can be skimmed off from the melt in the furnace vessel. This becomes possible by virtue of the arrangement shown in FIG. 4. As mentioned, the furnace vessel is, in each case, equipped with a lateral opening 9. Lateral opening 9, during heating of the melt, is closed off with a water-cooled door 27, as shown in FIG. 3. Opposite opening 9 in the vessels I or II is located one of the three supports 24, serving to support the furnace. That support 24 (see FIG. 4) is equipped with a lifting cylinder 25 which can tilt the vessel to a downward inclination of about 6° to the horizontal. The slag layer can then be skimmed off through lateral opening 9 and floor or tapping opening 8. The tapping opening 8 is provided through the furnace platform itself. The slag carriage is driven beneath the platform for receiving and taking away the removed slag. In order to allow the tilting of the vessel, the lid is first lifted off the vessel, as shown in FIG. 4. An expendable part, i.e., a piece 26 of one of the electrodes, above which the slag layer flows out of the vessel, lies in front of the furnace opening 9.

Figure 5:
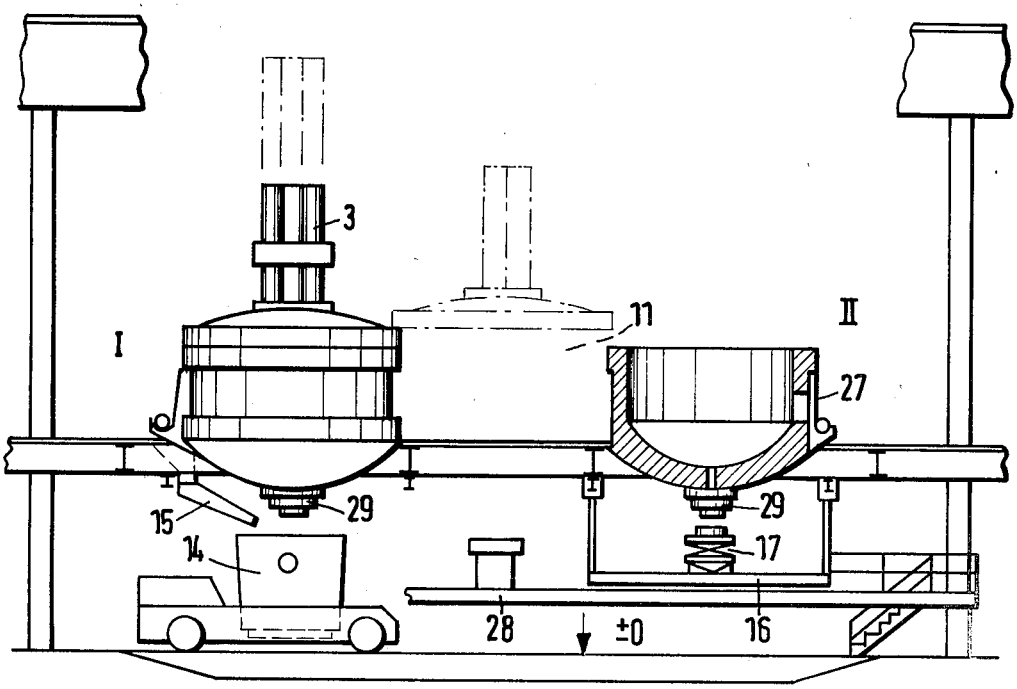
FIG. 5 is a frontal view of the steelmaking plant shown in FIG. 2.

The nature of the arrangement of the suspended platform 16 can best be seen in FIGS. 3 and 5. The platform 16 is suspended from above by downwardly extending rails. The guide rails for platform 16 are arranged sufficiently far apart from the bottom valve 29 of the furnace vessel so that there is adequate room provided for maintenance work. In the operational position, the suspended platform 16 is located below a furnace vessel I or II perpendicularly across the parallel rails provided for the steel discharging carriages and the slag carriages.

Figure 6:
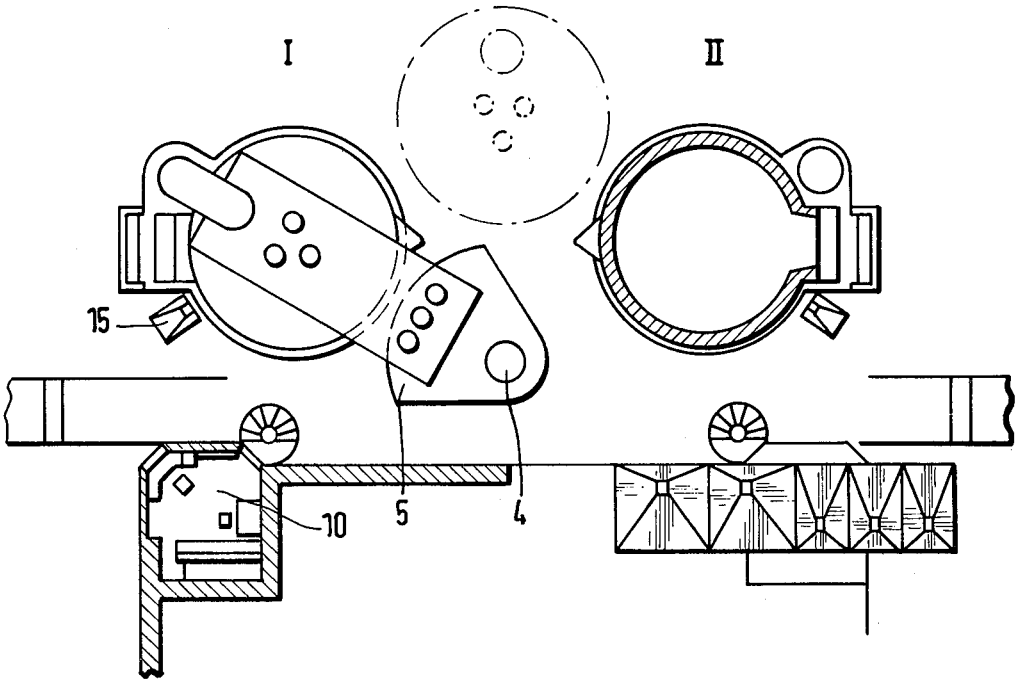
FIG. 6 is a top plan view, in more detail, of the present invention corresponding to FIG. 2.

FIG. 6 corresponds essentially to the showing of FIG. 2. In addition, however, further details are shown of the nature of the control post 10 and an observation bunker 15.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A metallurgical plant comprising:

(a) at least two electric arc type furnace vessels located proximate to one another and supported on a charging floor, (b) all of said furnace vessels being stationary and nonrotating during metallurgical processing and tapping, and having bottom located tapping mechanisms, said tapping mechanisms extending downwardly below said charging floor, (c) a number of furnace vessel lids comprising electric arc electrodes and associated electrical supply installations, said number of furnace vessel lids being at least one less than the total number of said furnace vessels, (d) said furnace vessel lids being supported for relative horizontal movement by a movable support structure, (e) said movable support structure being located at the center of an imaginary circle passing through the center of said furnace vessels so that said lids are individually capable of being selectively placed in working arrangement with all of said furnace vessels, and (f) said furnace vessels being further provided with selectively openable lateral deslagging openings and capable of being selectively downwardly tilted, about a horizontal plane, for deslagging through said deslagging openings.

2. A metallurgical plant as claimed in claim 1, wherein:

(a) said support structure comprises a cantilever support pivotable about a vertical axis passing through said center of said imaginary circle.

3. A metallurgical plant as claimed in claim 1, wherein:

(a) said support structure is a transportable gantry capable of selectively individually placing said lids, electric arc electrodes and associated electrical supply installations in working arrangement with all of said furnace vessels.

4. A metallurgical plant as claimed in claim 1, wherein:

(a) said furnace vessels are provided with tilting means, and (b) said tilting means being capable of tilting downward said furnace vessels about a horizontal axis by about 6° from the horizontal normal so that a slag layer can be skimmed from said furnace vessels.

5. A metallurgical plant as claimed in claim 1, wherein:

(a) said furnace vessels are individually supported on equidistantly spaced support members, and (b) said support members open upwardly.

6. A metallurgical plant as claimed in claim 5, wherein:

(a) one of said support members is placed diametrically opposite said lateral deslagging openings, and (b) lifting mechanisms are provided at said diametrically opposed support members for selectively tilting downwardly said lateral deslagging openings for skimming off the slag of said furnace vessels.

7. A metallurgical plant as claimed in claim 1, wherein:

(a) a mobile lift table is suspended below said charging floor and is capable of being selectively positioned beneath said bottom tapping mechanisms of said furnaces.

8. A metallurgical plant as claimed in claim 1, wherein:

(a) only two furnace vessels are used, and (b) the imaginary lines connecting the centers of said furnace vessels to the center of said imaginary circle is an angle of about 60°.

* * * * *